US005419362A

United States Patent [19]

Blackaby

[11] Patent Number: 5,419,362

[45] Date of Patent: May 30, 1995

[54] HOSE SUPPORTING DEVICE

[76] Inventor: Eldon R. Blackaby, 150 Kern La., Paris, Ark. 72855

[21] Appl. No.: 306,963

[22] Filed: Sep. 16, 1994

[51] Int. Cl.[6] ..... A62C 35/00

[52] U.S. Cl. ..... 137/355.16; 137/355.26; 248/89

[58] Field of Search ..... 137/355.12, 355.16, 137/355.26; 248/89

[56] References Cited

U.S. PATENT DOCUMENTS

| | | | |
|---|---|---|---|
| 955,260 | 4/1910 | Getman | 137/355.16 |
| 1,132,065 | 3/1915 | Bernhard | 248/89 |
| 4,436,267 | 3/1984 | Eado et al. | 248/89 |

*Primary Examiner*—A. Michael Chambers

[57] ABSTRACT

A hose supporting device comprising an inboard backing plate of a planar configuration positionable in a generally vertical orientation adjacent the side of a house proximate to a water faucet as a type having a horizontal pipe extending through the side of the house and a water bib positioned thereover, the backing plate having a keyhole-shaped aperture with a generally circular opening and a central extent thereof positonable over the water bib of the pipe, the opening having a pair of generally parallel edges extending downwardly with a vertical opening for positioning the aperture over the bib, the backing plate having a closed upper extent, vertical side extent and a lower extent; a n outboard retaining plate having an upper arcuate surface at an elevational extent, concentric with, but essentially the same as the arcuate surface of the inboard backing plate and having a lower arcuate surface essentially concentric with the upper backing plate and with vertical side edges generally co-extensive with the side.

5 Claims, 3 Drawing Sheets

FIG. 3
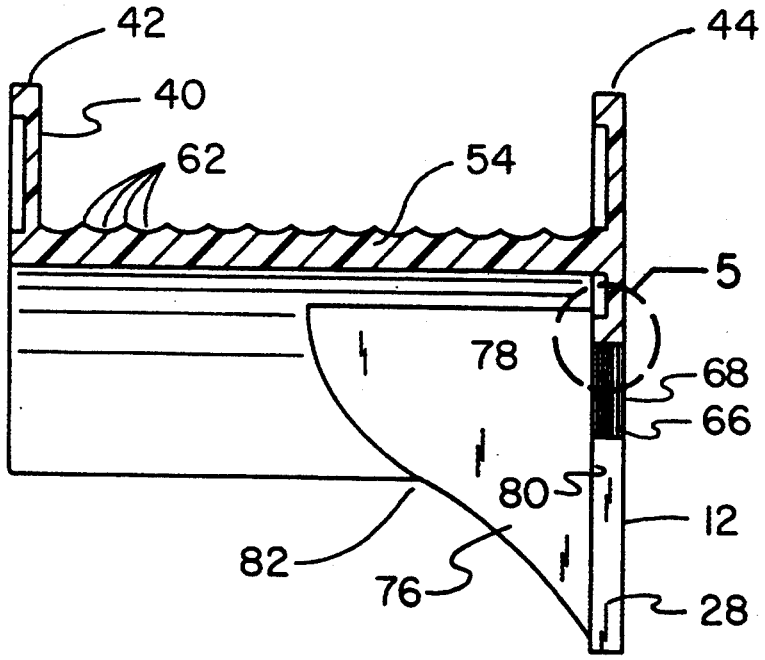
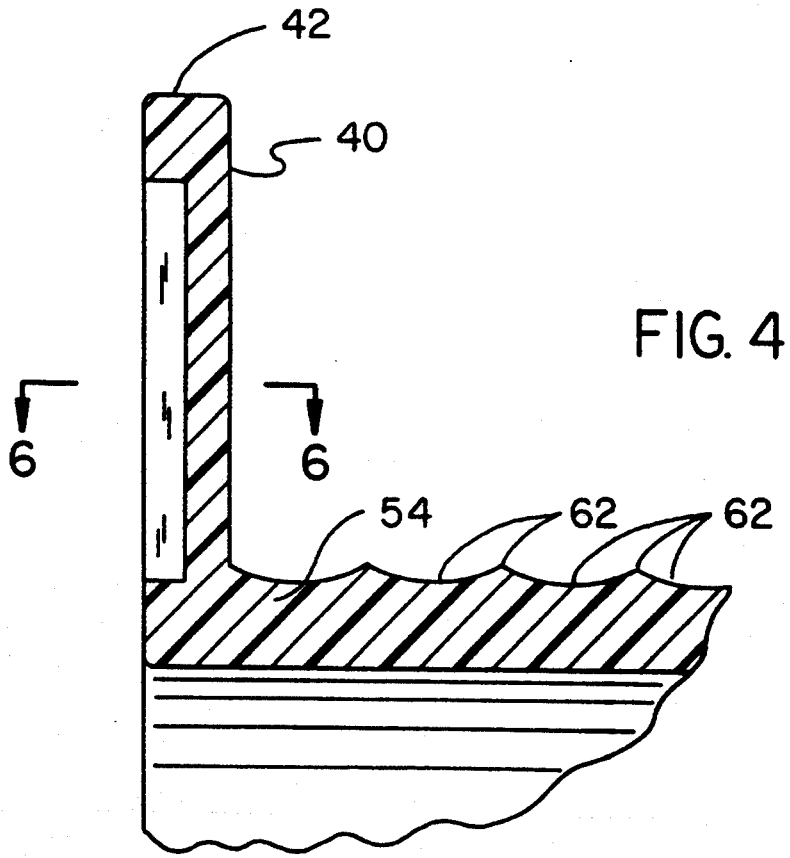
FIG. 4

FIG. 5
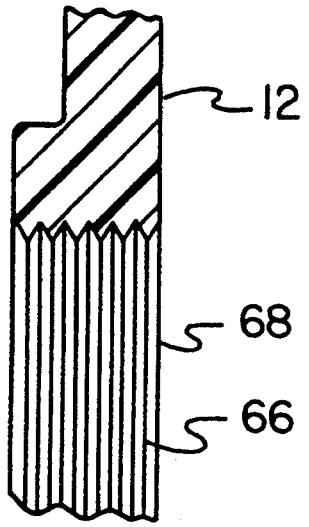
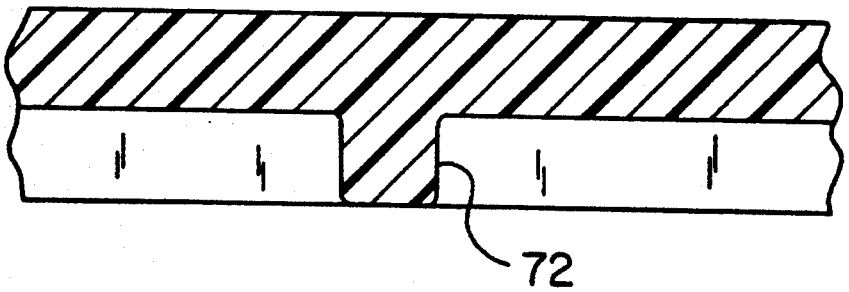
FIG. 6

HOSE SUPPORTING DEVICE

BACKGROUND OF THE INVENTION

1. Field of the Invention

The present invention relates to a new and improved hose supporting device and, more particularly, pertains to supporting a hose adjacent a water outlet valve with a support provided solely by the hose bib.

2. Description of the Prior Art

The use of devices for holding hoses at a predetermined location through a wide variety of apparatuses and devices is known in the prior art. More specifically, devices for holding hoses at a predetermined location through a wide variety of apparatuses and devices heretofore devised and utilized for the purpose of supporting hoses and other devices adjacent a house through supporting bolts, attachment mechanisms and a wide variety of methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for holding hoses at a predetermined location through a wide variety of apparatuses and devices. By way of example, U.S. Pat. No. 4,700,737 discloses a wall mount, caddy mount garden hose reel.

U.S. Pat. No. Des. 245,556 discloses the design of a nozzle holder for garden hose.

U.S. Pat. No. Des. 290,809 discloses the design of a garden hose holder.

U.S. Pat. No. Des. 306,681 discloses the design of a garden hose nozzle holder.

Lastly, U.S. Pat. No. Des. 334,529 discloses the design of another garden hose holder.

In this respect, the hose supporting device according to the present invention substantially departs from the conventional concepts and designs of the prior art, and in doing so provides an apparatus primarily developed for the purpose of supporting a hose adjacent a water outlet valve with a support provided solely by the hose bib.

Therefore, it can be appreciated that there exists a continuing need for a new and improved hose supporting device which can be used for supporting a hose adjacent a water outlet valve with a support provided solely by the hose bib. In this regard, the present invention substantially fulfills this need.

SUMMARY OF THE INVENTION

In view of the foregoing disadvantages inherent in the known types of devices for holding hoses at a predetermined location through a wide variety of apparatuses and devices now present in the prior art, the present invention provides a new and improved hose supporting device. As such, the general purpose of the present invention, which will be described subsequently in greater detail, is to provide a new and improved hose supporting device and methods which have all the advantages of the prior art and none of the disadvantages.

To attain this, the present invention essentially comprises a new and improved hose supporting device comprising, in combination, an inboard backing plate of a planar configuration positionable in a vertical orientation adjacent the side of a house proximate to a water faucet as a type having a horizontal pipe extending through the side of the house and a water bib positioned thereover, the backing plate having a keyhole-shaped aperture with a generally circular opening and a central extent thereof positonable over the water bib of the pipe, the opening having a pair of parallel edges extending downwardly with a vertical opening for positioning the aperture over the bib, the backing plate having a closed upper extent, vertical side extent and a lower extent; an outboard retaining plate having an upper arcuate surface at an elevational extent, concentric with, but essentially the same as the arcuate surface of the inboard backing plate and having a lower arcuate surface essentially concentric with the upper backing plate and with vertical side edges generally co-extensive with the side edges of the backing plate; an arcuate support plate for receiving a hose, the arcuate plate having an inboard edge at a central extent of the backing plate and having an outboard edge secured to the lower edge of the support plate, the support plate having arcuate undulations essentially concentric with the upper edges of the backing plate and retaining plate; a plurality of threads formed in the aperture at its upper extent for positioning over the threads of the pipe; a plurality of ribs formed in the retaining plate and the backing plate for increased rigidity; and outboardly extending vertical braces having an upper horizontal edge, a rearward vertical edge and a curved angular edge therebetween positioned beneath the support surface and the backing surface for providing additional support to a hose located thereon.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hose supporting device which has all the advantages of the prior art devices for holding hoses at a predetermined location through a wide variety of apparatuses and devices and none of the disadvantages.

It is another object of the present invention to provide a new and improved hose supporting device which may be easily and efficiently manufactured and marketed.

It is a further object of the present invention to provide a new and improved hose supporting device which is of a durable and reliable construction.

An even further object of the present invention is to provide a new and improved hose supporting device which is susceptible of a low cost of manufacture with regard to both materials and labor, and which accordingly is then susceptible of low prices of sale to the consuming public, thereby making such a hose supporting device economically available to the buying public.

Still yet another object of the present invention is to provide a new and improved hose supporting device which provides in the apparatuses and methods of the prior art some of the advantages thereof, while simultaneously overcoming some of the disadvantages normally associated therewith.

Even still another object of the present invention is to support a hose adjacent a water outlet valve with a support provided solely by the hose bib.

Lastly, it is an object of the present invention to provide a hose supporting device comprising an inboard backing plate of a planar configuration positionable in a generally vertical orientation adjacent the side of a house proximate to a water faucet as a type having a horizontal pipe extending through the side of the house and a water bib positioned thereover, the backing plate having a keyhole-shaped aperture with a generally circular opening and a central extent thereof positonable over the water bib of the pipe, the opening having a pair of generally parallel edges extending downwardly with a vertical opening for positioning the aperture over the bib, the backing plate having a closed upper extent, vertical side extent and a lower extent; a n outboard retaining plate having an upper arcuate surface at an elevational extent, concentric with, but essentially the same as the arcuate surface of the inboard backing plate and having a lower arcuate surface essentially concentric with the upper backing plate and with vertical side edges generally co-extensive with the side edges of the backing plate; and an arcuate support plate for receiving a hose, the arcuate plate having an inboard edge at a central extent of the backing plate and having an outboard edge secured to the lower edge of the support plate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view taken vertically through the center of the device shown in FIGS. 1 and 2.

FIG. 4 is an enlarged cross-sectional view of the outboard supporting base of the device shown in FIGS. 2 and 3.

FIG. 5 is an enlarged cross-sectional view taken about circle 5 of FIG. 3.

FIG. 6 is a cross-sectional view taken along line 6—6 of FIG. 4.

The same reference numerals refer to the same parts throughout the various Figures.

DESCRIPTION OF THE PREFERRED EMBODIMENT

Figure 1:
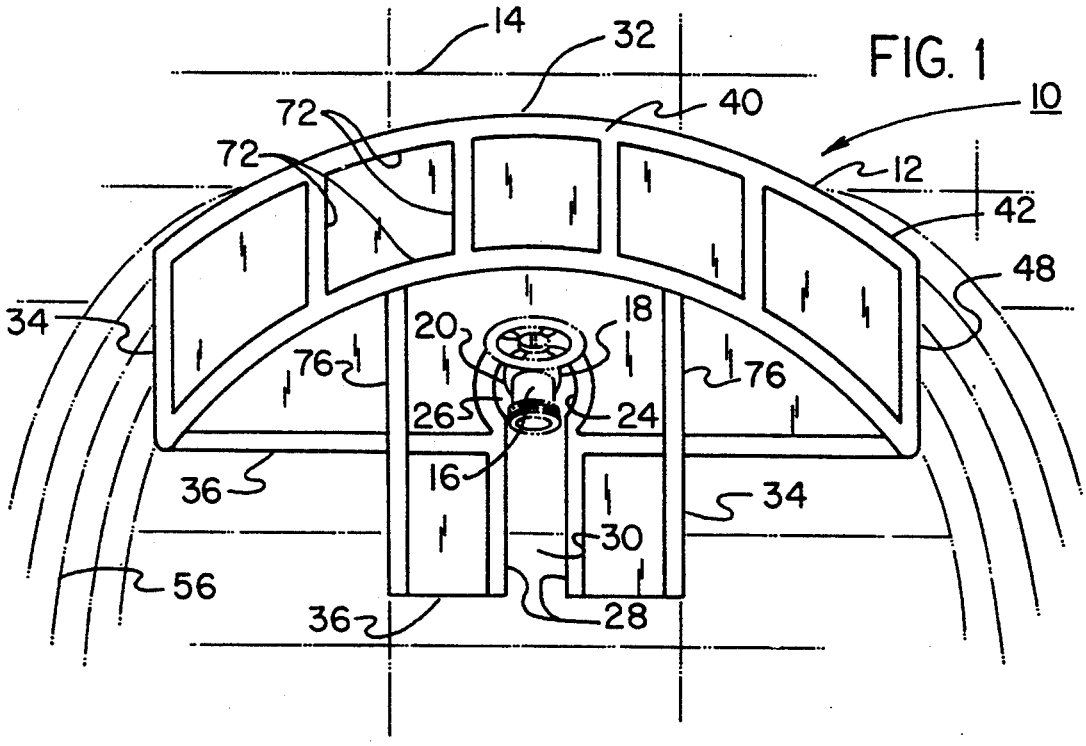
FIG. 1 is a front elevational view of the preferred embodiment of the new and improved hose supporting device constructed in accordance with the principles of the present invention.
Figure 2:
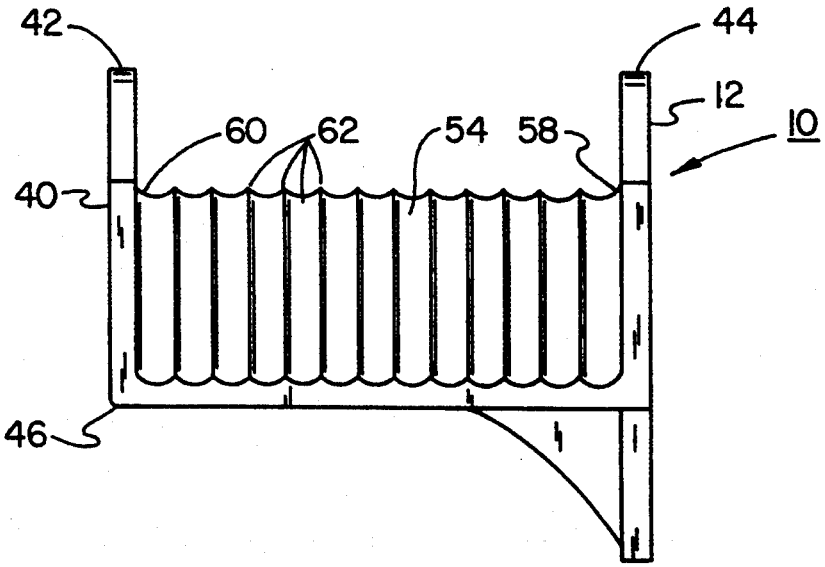
FIG. 2 is a side elevational view of the device shown in FIG. 1.

With reference now to the drawings, and in particular to FIGS. 1 through 6 thereof, the preferred embodiment of the new and improved hose supporting device embodying the principles and concepts of the present invention and generally designated by the reference numeral 10 will be described.

The present invention, the new and improved hose supporting device is a system 10 comprised of a plurality of components. Such components, in their broadest context, include an inboard packing plate, an outboard retaining plate, an arcuate support plate, a plurality of threads, a plurality of ribs, and an outboard extending vertical brace. Each of the individual components is specifically configured and correlated one with respect to the other so as to attain the desired objectives.

The main component of the device 10 of the present invention is an inboard packing plate 12. It is of a planar configuration. It is positionable in a vertical orientation adjacent to the side 14 of a house in proximity to a water faucet 16. The water faucet is of the type having a horizontal pipe 18 extending through the side of the house for selectively dispensing water therefrom. A water bib 20 is positioned over the pipe immediately exterior of the wall.

The backing plate is formed with a centrally disposed keyhole-shaped aperture 24. Such aperture has a generally circular opening 26. It also has a central extent thereof which is positionable over the water bib of the pipe. The opening has a pair of parallel edges 28 extending downwardly from the aperture 24. The edges provide a vertical opening 30 spaced slightly greater than the diameter of the pipe. This opening is for the positioning of the aperture over the bib. The backing plate also has a closed upper extent 32, vertical side extents 34 and a lower extent 36.

Next provided in the device 10 is an outboard retaining plate 40. Such plate has an upper arcuate surface 42. It is disposed at an elevational extent, concentric with, but essentially the same as the arcuate surface 44 of the inboard packing plate. The outboard retaining plate has a lower arcuate surface 46 essentially concentric with the upper backing plate. It also has vertical side edges 48 which are generally co-extensive with the side edges 34 of the backing plate.

Next provided in the device 10 is an arcuate support plate 54. Such support plate functions for receiving a hose 56. The arcuate plate has an inboard edge 58 at a central extent of the backing plate. It also has an outboard edge 60 secured to a lower edge of the support plate. The support plate has arcuate undulations 62 which are formed essentially concentric with the upper edges of the backing plate and retaining plate.

Formed in the aperture 24 at its upper extent are a plurality of threads 66. Such threads are for positioning over the threads of the pipe securing the backing plate in position. The threads of the aperture and the threads of the pipe tend to abate inadvertent horizontal motion with respect to each other.

Next provided are a plurality of ribs 72. Such ribs are formed in the retaining plate and the backing plate. Their function is to provide increased rigidity to the device during operation and use.

The last component of the device 10 are a pair of outboardly extending vertical braces 76. Each of the braces has an upper horizontal edge 78, a rearward vertical edge 80 and a curved angular edge 82 between the horizontal and vertical edges. The braces are positioned between the support surface and the backing surface for providing additional support to a hose located thereon when in storage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hose supporting device comprising:

an inboard backing plate of a planar configuration positionable in a generally vertical orientation adjacent the side of a house proximate to a water faucet as a type having a horizontal pipe extending through the side of the house and a water bib positioned thereover, the backing plate having a keyhole-shaped aperture with a generally circular opening and a central extent thereof positonable over the water bib of the pipe, the opening having a pair of generally parallel edges extending downwardly with a vertical opening for positioning the aperture over the bib, the backing plate having a closed upper extent, vertical side extent and a lower extent;

an outboard retaining plate .having an upper arcuate surface at an elevational extent, concentric with, but essentially the same as the arcuate surface of the inboard backing plate and having a lower arcuate surface essentially concentric with the upper backing plate and with vertical side edges generally co-extensive with the side edges of the backing plate; and an arcuate support plate for receiving a hose, the arcuate plate having an inboard edge at a central extent of the backing plate and having an outboard edge secured to the lower edge of the support plate.

2. The device as set forth in claim 1 wherein the support plate has arcuate undulations essentially concentric with the upper edges of the backing plate and retaining plate.

3. The device as set forth in claim 1 and further including:

a plurality of threads formed in the aperture at its upper extent for positioning over the threads of the pipe.

4. The device as set forth in claim 1 and further including:

a plurality of ribs formed in the retaining plate and the backing plate for increased rigidity; and outboardly extending vertical braces having an upper horizontal edge, a rearward vertical edge and a curved angular edge therebetween positioned beneath the support surface and the backing surface for providing additional support to a hose located thereon.

5. A new and improved hose supporting device comprising, in combination:

an inboard backing plate of a planar configuration positionable in a vertical orientation adjacent the side of a house proximate to a water faucet as a type having a horizontal pipe extending through the side of the house and a water bib positioned thereover, the backing plate having a keyhole-shaped aperture with a generally circular opening and a central extent thereof positonable over the water bib of the pipe, the opening having a pair of parallel edges extending downwardly with a vertical opening for positioning the aperture over the bib, the backing plate having a closed upper extent, vertical side extent and a lower extent;

an outboard retaining plate having an upper arcuate surface at an elevational extent, concentric with, but essentially the same as the arcuate surface of the inboard backing plate and having a lower arcuate surface essentially concentric with the upper backing plate and with vertical side edges generally co-extensive with the side edges of the backing plate;

an arcuate support plate for receiving a hose, the arcuate plate having an inboard edge at a central extent of the backing plate and having an outboard edge secured to the lower edge of the support plate, the support plate having arcuate undulations essentially concentric with the upper edges of the backing plate and retaining plate;

a plurality of threads formed in the aperture at its upper extent for positioning over the threads of the pipe;

a plurality of ribs formed in the retaining plate and the backing plate for increased rigidity; and outboardly extending vertical braces having an upper horizontal edge, a rearward vertical edge and a curved angular edge therebetween positioned beneath the support surface and the backing surface for providing additional support to a hose located thereon.

* * * * *